US012180788B2

(12) United States Patent
D'Silva et al.

(10) Patent No.: US 12,180,788 B2
(45) Date of Patent: Dec. 31, 2024

(54) DRILL STRING WITH CENTRALIZER

(71) Applicant: Halliburton Energy Services, Inc., Houston, TX (US)

(72) Inventors: Alben D'Silva, Edmonton (CA); Philip Park Hung Leung, Houston, TX (US); Steven Graham Bell, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 23 days.

(21) Appl. No.: 17/393,212

(22) Filed: Aug. 3, 2021

(65) Prior Publication Data

US 2022/0389774 A1 Dec. 8, 2022

Related U.S. Application Data

(60) Provisional application No. 63/202,268, filed on Jun. 3, 2021.

(51) Int. Cl.
*E21B 17/10* (2006.01)

(52) U.S. Cl.
CPC ..... *E21B 17/1057* (2013.01)

(58) Field of Classification Search
CPC ..... E21B 17/1057; E21B 17/1064
See application file for complete search history.

(56) References Cited

U.S. PATENT DOCUMENTS 4,549,613 A 10/1985 Case
5,094,304 A * 3/1992 Briggs ..... E21B 7/068 175/325.3
5,743,333 A * 4/1998 Willauer ..... E21B 33/1277 166/134
6,152,220 A 11/2000 Carmichael et al.
6,695,080 B2 2/2004 Presley et al.
7,299,886 B2 11/2007 Wenzel
(Continued)

FOREIGN PATENT DOCUMENTS

AU 2019208261 B2 10/2020
CA 1154430 A 9/1983
(Continued)

OTHER PUBLICATIONS

International Search Report and Written Opinion dated Feb. 25, 2022 for corresponding PCT Application No. PCTUS2021071097 filed Aug. 4, 2021.
(Continued)

*Primary Examiner* — Theodore N Yao
(74) *Attorney, Agent, or Firm* — K&L Gates LLP

(57) ABSTRACT

A drill string for drilling a borehole. The drill string may include a downhole motor operable to rotate the drill string and a centralizer assembly. The centralizer assembly may include an outer housing, a lower sub threadably engaged with the outer housing, and a centralizer. The centralizer may include a single eccentric blade, an internal shoulder positioned between the outer housing and the lower sub, and an alignment profile to align the centralizer in an azimuthal position relative to the drill string. The centralizer may be retainable in the aligned azimuthal position by the alignment profile and the internal shoulder being engaged by the outer housing and the lower sub.

17 Claims, 5 Drawing Sheets

(56) References Cited

U.S. PATENT DOCUMENTS

| | | | | |
|---|---|---|---|---|
| 8,074,747 | B2 | 12/2011 | Radford et al. | |
| 9,145,746 | B1 | 9/2015 | Smith | |
| 9,217,301 | B1 * | 12/2015 | Latham | E21B 17/1078 |
| 9,249,630 | B2 | 2/2016 | Downie et al. | |
| 9,297,209 | B1 | 3/2016 | Smith et al. | |
| 9,428,963 | B1 | 8/2016 | Smith et al. | |
| 9,470,048 | B1 | 10/2016 | Smith et al. | |
| 9,562,401 | B1 | 2/2017 | Smith | |
| 9,593,534 | B2 * | 3/2017 | Toler, Jr. | E21B 7/10 |
| 9,598,913 | B2 * | 3/2017 | Buytaert | E21B 17/1078 |
| 9,624,728 | B2 | 4/2017 | Crowley et al. | |
| 9,670,742 | B2 | 6/2017 | Anderson | |
| 10,053,925 | B1 | 8/2018 | Smith et al. | |
| 10,119,336 | B2 | 11/2018 | Downie et al. | |
| 10,590,717 | B2 | 3/2020 | Smith et al. | |
| 2004/0026131 | A1 | 2/2004 | Boulet et al. | |
| 2007/0289782 | A1 | 12/2007 | Clark et al. | |
| 2014/0305711 | A1 | 10/2014 | Downie et al. | |
| 2015/0041218 | A1 * | 2/2015 | Toler, Jr. | E21B 17/1064 175/78 |
| 2016/0194919 | A1 | 7/2016 | Zaki et al. | |
| 2017/0074054 | A1 | 3/2017 | Newman | |
| 2019/0078399 | A1 | 3/2019 | Smith et al. | |

FOREIGN PATENT DOCUMENTS

| | | | | | |
|---|---|---|---|---|---|
| CA | 2872546 | C | | 1/2018 | |
| CA | 2980457 | C | | 6/2019 | |
| CN | 106285512 | A | * | 1/2017 | E21B 17/10 |
| CN | 109555488 | A | | 4/2019 | |
| CN | 210087255 | U | | 2/2020 | |
| EP | 0254900 | B1 | | 4/1990 | |
| EP | 1650400 | B1 | | 4/2008 | |
| MX | 355956 | B | | 5/2018 | |
| WO | WO-2015104347 | A1 | * | 7/2015 | E21B 17/1057 |
| WO | 2018151718 | A1 | | 8/2018 | |

OTHER PUBLICATIONS

Graham Mensa-Wilmot et al., Identifying and Addressing New Vibrations Source Holistically Little Things Have Big Effects, Identifying and Addressing New Vibrations Source Holistically Little Things Have Big Effects, Maxdrill Data Driven-Performance Improvement, 6 pages.

Paul E. Pastusek, Stabilizer Selection Based on Physics and Lessons Learned, IADC/SPE Drilling Conference and Exhibition, Fort Worth, TX, Mar. 2018.

* cited by examiner

DRILL STRING WITH CENTRALIZER

BACKGROUND

This section is intended to provide relevant background information to facilitate a better understanding of the various aspects of the described embodiments. Accordingly, it should be understood that these statements are to be read in this light and not as admissions of prior art.

Downhole motors, also known as Moineau-type motors, having a rotor that rotates within a stator using pressurized drilling fluid have been used in borehole drilling applications for many years. Some downhole motors used in borehole drilling include stators having an elastomer compound bonded to a steel structure. Pressurized drilling fluid (e.g., drilling mud) is typically driven into the motor and into a cavity between the rotor and the stator, which generates rotation of the rotor and a resulting torque can be produced. The resulting torque is typically used to drive a working tool, such as a drill bit, to cut material.

Often, centralizers are used in conjunction with such downhole motors to centralize the drill string within the borehole. While centralizers typically have 3 or more blades, a centralizer with only one blade, also known as an "eccentric centralizer" or an "offset centralizer," may be used during certain drilling operations where the borehole is only slightly larger than the circumference of the drill string. Further, it is desirable to reduce the circumference of the drill string, including the portion of the drill string that includes centralizer, to provide additional clearance within such boreholes.

BRIEF DESCRIPTION OF THE DRAWINGS

The present disclosure is described with reference to the following figures. The same numbers are used throughout the figures to reference like features and components. The features depicted in the figures are not necessarily shown to scale. Certain features may be shown exaggerated in scale or in somewhat schematic form, and some details of elements may not be shown in the interest of clarity and conciseness.

DETAILED DESCRIPTION

The present disclosure provides a centralizer that centralizes a drill string that includes a downhole motor. The centralizer is coupled to a bearing assembly of the drill string via a lower sub that is threaded onto the bearing assembly to retain the centralizer in position. Additionally, the centralizer includes an alignment profile that engages with a mating profile on either the lower sub or the outer housing of the bearing assembly to align the centralizer in a desired position relative to the drill string. The alignment profile retains the alignment of the centralizer relative to the drill string as the drill string drills the borehole.

A subterranean formation containing oil or gas hydrocarbons may be referred to as a reservoir, in which a reservoir may be located on-shore or off-shore. Reservoirs are typically located in the range of a few hundred feet (shallow reservoirs) to tens of thousands of feet (ultra-deep reservoirs). To produce oil, gas, or other fluids from the reservoir, a well is drilled into a reservoir or adjacent to a reservoir.

A well can include, without limitation, an oil, gas, or water production well, or an injection well. As used herein, a "well" includes at least one borehole having a borehole wall. A borehole can include vertical, inclined, and horizontal portions, and it can be straight, curved, or branched. As used herein, the term "borehole" includes any cased, and any uncased, open-hole portion of the borehole. Further, the term "uphole" refers a direction that is towards the surface of the well, while the term "downhole" refers a direction that is away from the surface of the well.

Figure 1:
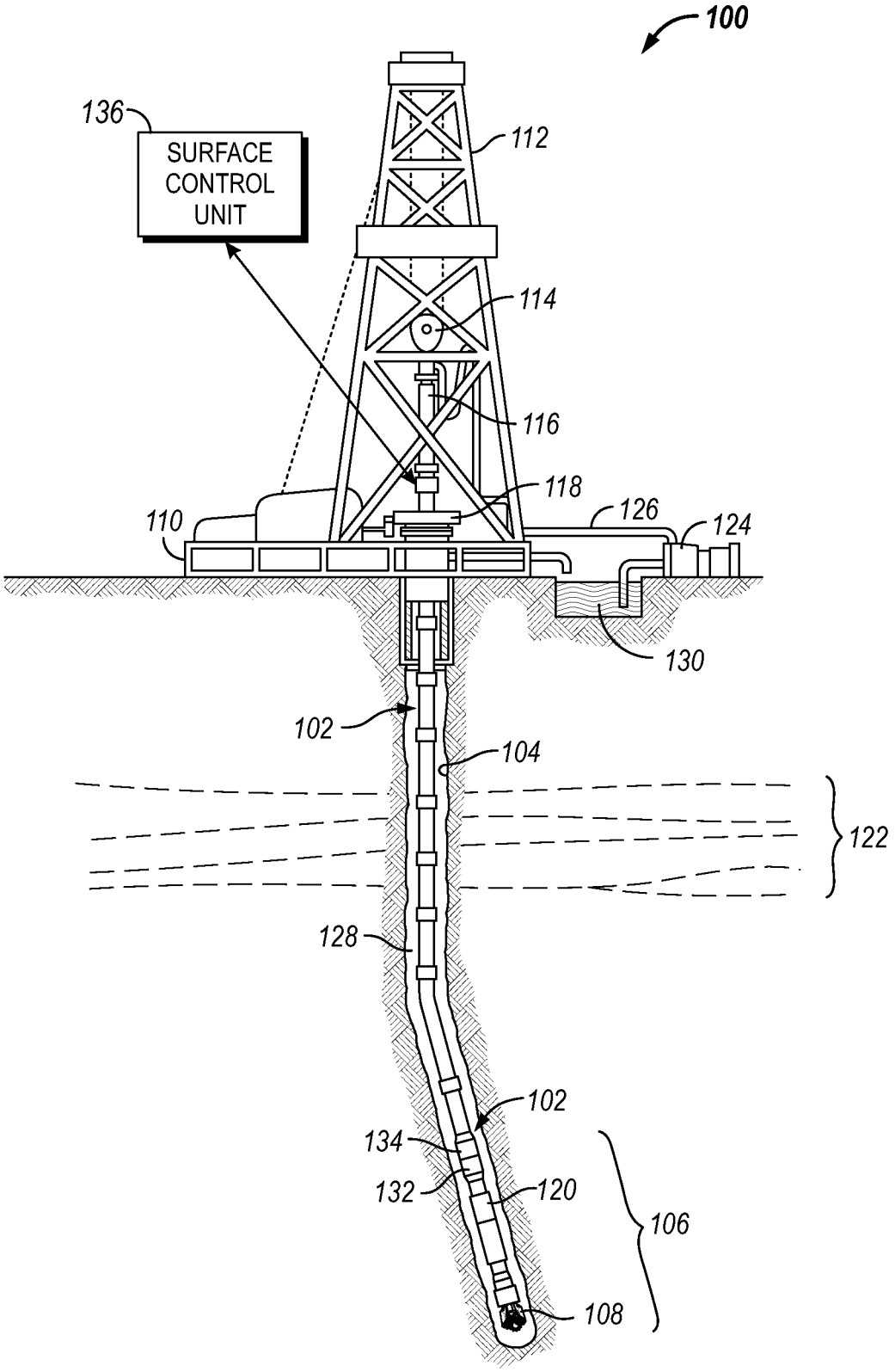
FIG. 1 is a schematic view of a drilling system, according to one or more embodiments.

Turning now to FIG. 1, FIG. 1 is a schematic view of a drilling system 100, according to one or more embodiments. The drilling system 100 of the present disclosure will be specifically described below such that the system is used to direct a drill bit in drilling a wellbore, such as a subsea well or a land well. Further, it will be understood that the present disclosure is not limited to only drilling an oil well. The present disclosure also encompasses natural gas wellbores, other hydrocarbon wellbores, or wellbores in general. Further, the present disclosure may be used for the exploration and formation of geothermal wellbores intended to provide a source of heat energy instead of hydrocarbons.

FIG. 1 shows a drill string 102 disposed in a directional borehole 104. The drill string 102 includes a bottom-hole assembly ("BHA") 106 that includes a drill bit 108. A drilling platform 110 supports a derrick 112 having a traveling block 114 for raising and lowering a drill string 102. A kelly 116 supports the drill string 102 as the drill string 102 is lowered through a rotary table 118. Alternatively, a top drive can be used to rotate the drill string 102 in place of the kelly 116 and the rotary table 118. A drill bit 108 is positioned at the downhole end of the drill string 102 and is driven by rotation of the entire drill string 102 from the surface and/or by a downhole motor 120 positioned on the drill string 102.

As the bit 108 rotates, the bit 108 forms the borehole 104 that passes through various formations 122. A pump 124 circulates drilling fluid through a feed pipe 126 and downhole through the interior of drill string 102, through orifices in drill bit 108, back to the surface via the annulus 128 around drill string 102, and into a retention pit 130. The drilling fluid transports cuttings from the borehole 104 into the pit 130 and aids in maintaining the integrity of the borehole 104. The drilling fluid also drives the downhole motor 120, as discussed in more detail below.

The BHA 106 may include one or more logging while drilling (LWD) or measurement-while-drilling (MWD) tools 132 that collect measurements relating to various borehole and formation properties as well as the position of the bit 108 and various other drilling conditions as the bit 108 extends the borehole 104 through the formations 122. The LWD/MWD tool 132 may include a device for measuring formation resistivity, a gamma ray device for measuring formation gamma ray intensity, devices for measuring the inclination and azimuth of the drill string 102, pressure sensors for measuring drilling fluid pressure, temperature sensors for measuring borehole temperature, etc.

The BHA 106 may also include a telemetry module 134. The telemetry module 134 receives data provided by the various sensors of the drill string 102 (e.g., sensors of the LWD/MWD tool 132), and transmits the data to a surface unit 136. Data may also be provided by the surface unit 136, received by the telemetry module 134, and transmitted to the tools (e.g., LWD/MWD tool 132, etc.) of the BHA 106. Mud pulse telemetry, wired drill pipe, acoustic telemetry, or other telemetry technologies known in the art may be used to provide communication between the surface control unit 136 and the telemetry module 134. The surface unit 136 may also communicate directly with the LWD/MWD tool 132 or other tools of the BHA 106. The surface unit 136 may be a computer stationed at the well site, a portable electronic device, a remote computer, or distributed between multiple locations and devices. The unit 136 may also be a control unit that controls functions of the equipment of the drill string 102.

Figure 2:
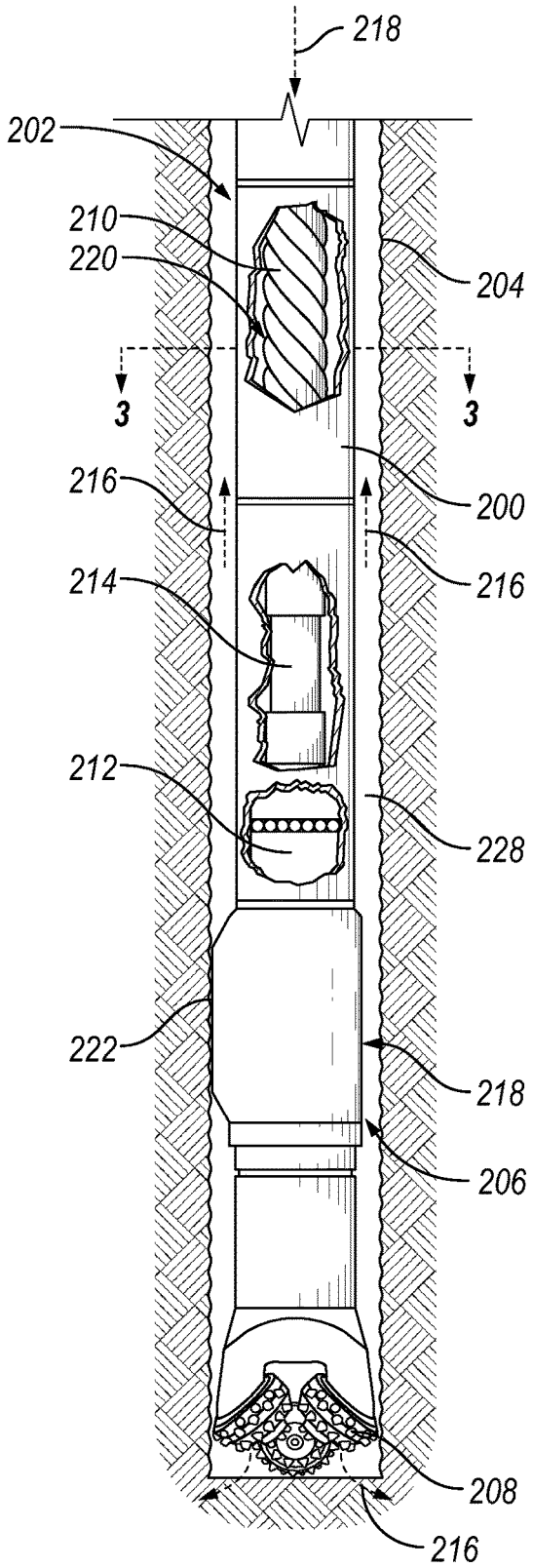
FIG. 2 is a portion of a drill string disposed in a borehole, according to one or more embodiments.
Figure 3:
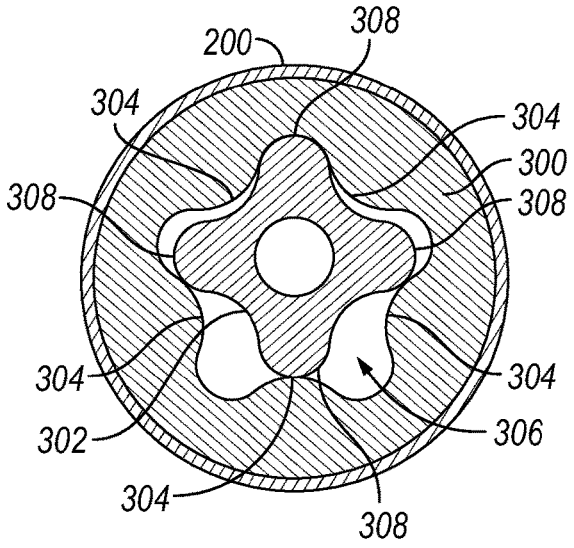
FIG. 3 is a cross-sectional view of the stator and rotor of FIG. 2.

FIGS. 2 and 3 are a broken side view and a cross section view of a drill string 202 disposed in a borehole 204 and that includes a downhole motor 220 connected to a drill bit 208. The downhole motor 220 includes a tubular housing 200 that encloses a power unit 210. The power unit 210 is connected to a bearing assembly 212 via a transmission unit 214. The bearing assembly 212 supports a driveshaft (not shown) extending between the downhole motor 220 and the drill bit 208 to rotate the drill bit 208. A centralizer assembly 206 is coupled to or is a subassembly of the bearing assembly 212. The centralizer assembly 206 is used to centralize the drill string 202 within the borehole 204. The centralizer assembly 206 includes a centralizer 218 having single blade 222, which is also referred to as a "kick pad," that contacts the borehole wall while drilling the borehole 204. The contact between the borehole wall and the blade 222 centralizes the drill string 202 within the borehole 204.

Referring to FIG. 3, the power unit 210 includes a stator 300 and a rotor 302. The stator 300 includes multiple (e.g., five) lobes 304 extending along the stator 300 in a helical configuration and defining a cavity 306. The rotor 302 also includes lobes 308 extending along the rotor 302 in a helical configuration. The stator 300 and rotor 302 can also have more or fewer lobes where the difference between the rotor lobes 308 and stator lobes 304 is one extra stator lobe 304 for the number of rotor lobes 308.

The rotor 302 is operatively positioned in the cavity 306 such that the rotor lobes cooperate with the stator lobes 304 in that applying fluid pressure to the cavity 306 by flowing fluid within the cavity 306 causes the rotor 302 to rotate within the stator 300. For example, referring to FIGS. 2 and 3, pressurized drilling fluid (e.g., drilling mud) 216 can be introduced at an upper end of the power unit 210 and forced down through the cavity 306. The pressurized drilling fluid entering cavity 306, in cooperation with the lobes 304 of the stator 300 and the geometry of the stator 300 and the rotor 302 causes the rotor 302 to turn to allow the drilling fluid 216 to pass through the motor 220, thus rotating the rotor 302 relative to the stator 300. The drilling fluid 216 subsequently exits through ports (e.g., jets) in the drill bit 208 and travels upward through an annulus 228 between the drill string 202 and the borehole 204 and is received at the surface where it is captured and pumped down the drill string 202 again.

Figure 4:
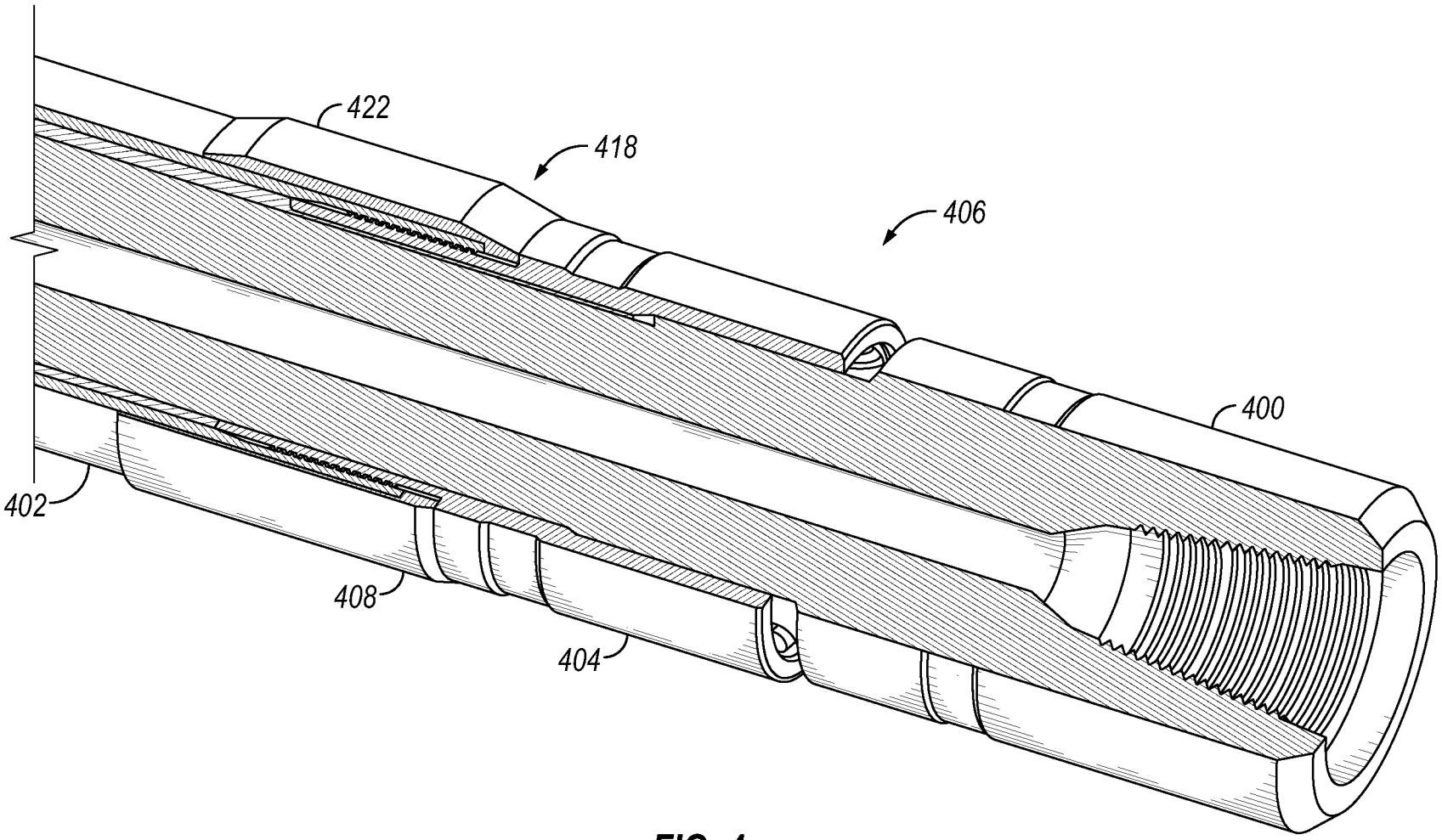
FIG. 4 a partial, sectional view of a bearing assembly, according to one or more embodiments.

Turning now to FIGS. 4, FIG. 4 is a partial, sectional view of a centralizer assembly 406, according to one or more embodiments. The centralizer assembly 406 may be coupled to a bearing assembly (not shown) that supports a driveshaft 400 extending between a downhole motor (not shown) and a drill bit (not shown) to rotate the drill bit. The centralizer assembly 406 includes an outer housing 402, a centralizer 418 that includes a single blade 422, and a lower sub 404.

As shown in FIG. 4, the centralizer 418 is positioned between the outer housing 402 and the lower sub 404. The centralizer 418 is retained in position via a shoulder portion 408 of the centralizer 418 engaged by the lower sub 404 when the lower sub 404 is threadably engaged with outer housing 402. Although the centralizer 418 is positioned on the downhole end the centralizer assembly 406 in the illustrated embodiment, the invention is not thereby limited. In other embodiments, the centralizer 418 may be positioned on an uphole end of the centralizer assembly 406 and the lower sub 404 may be uphole of the centralizer 418.

Figure 5:
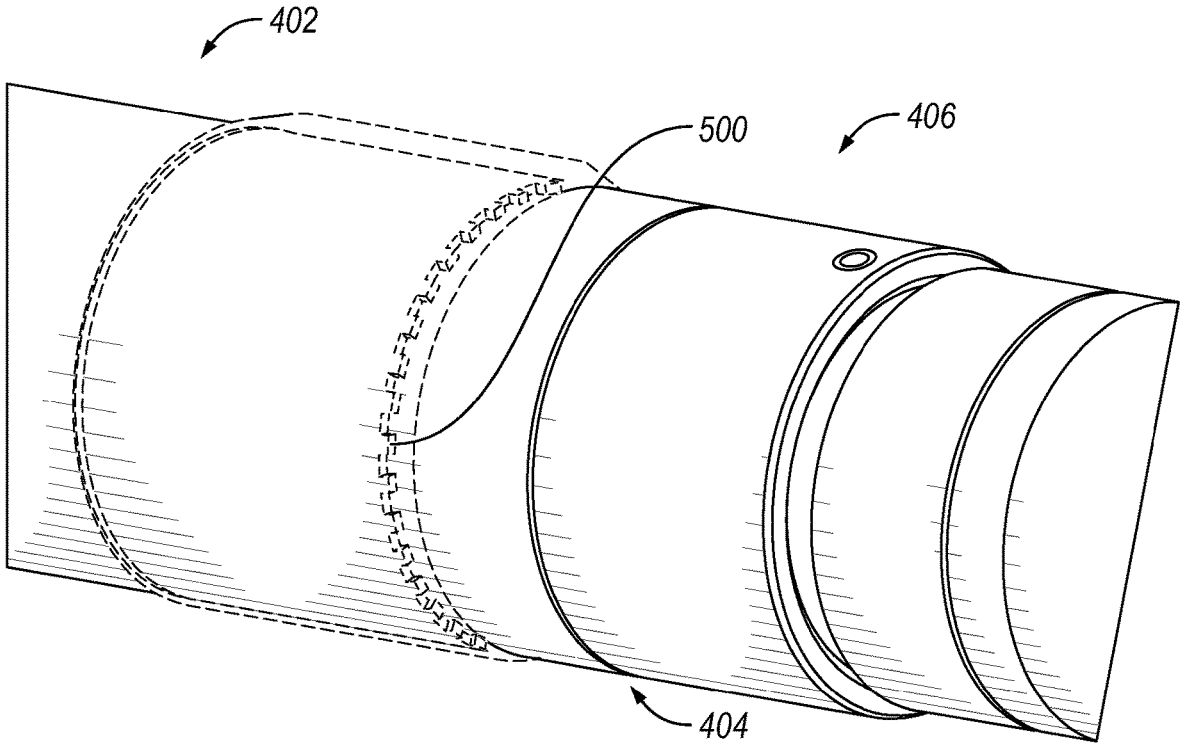
FIG. 5 is partial view of the bearing assembly of FIG. 4 without a centralizer.
Figure 6:
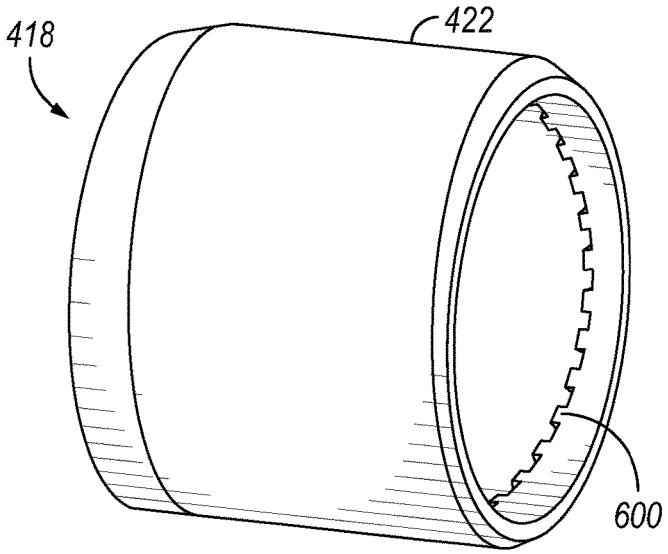
FIG. 6 is an isometric view of the centralizer of FIG. 4.

Turning now to FIGS. 5 and 6, FIGS. 5 and 6 are a partial view of the centralizer assembly 406 of FIG. 4 without a centralizer 418 and an isometric view of the centralizer 418 of FIG. 4, respectively. As shown in FIG. 5, the outer housing 402 includes a mating profile 500 that engages with an alignment profile 600 of the centralizer 418, shown in FIG. 6, to align the centralizer 418 on the drill string once the centralizer 418 is positioned around the outer housing 402, as shown in FIG. 4. The alignment of the centralizer 418 is then retained by threading the lower sub 404 onto the outer housing 402. The alignment profile 600 and mating profile 500 allow the centralizer to be retained in an aligned position relative to the outer housing and/or the drill string once the lower sub 404 is threaded onto the outer housing 402.

Although the mating profile 500 is shown as part of the outer housing 402 in FIG. 5, the mating profile 500 may also be formed in the lower sub 404 and the profile 600 may be positioned on the centralizer 418 to engage with a mating profile (not shown) on the lower sub. Further, the profiles 500, 600 may be rectangular teeth, as shown in FIGS. 5 and 6, triangular teeth, or any other tooth profile that allows the centralizer 418 to be aligned on the drill string and retained in position once aligned. Additionally, the alignment profile 600 and/or the mating profile 500 may only be formed on a portion of the respective diameters, instead of extending around the full diameter of the centralizer 418 and the outer housing 402.

In at least one embodiment, the centralizer 418 may include an alignment profile 600 having splines instead the teeth shown in FIGS. 5 and 6. In such an embodiment, the gaps between the teeth in the alignment profile 500 may be extended across the entire shoulder 408 to form splines in the centralizer 418. The splines may engage with a mating profile 500 on either the outer housing 402 or the lower sub 404 that includes grooves shaped to receive the splines of the centralizer 418.

The centralizer assembly 406 shown in FIGS. 4-6 allows for a reduction in the overall circumference of the drill string proximate the centralizer 418 when compared to the centralizers that use shims to retain the centralizer in position once aligned relative to the drill string. Further, the exemplary centralizer assembly 406 allows the centralizer 418 to be positioned near the drill bit, improving performance of the centralizer 418 when compared to centralizers 418 located uphole of the bearing assembly (not shown).

Figure 7:
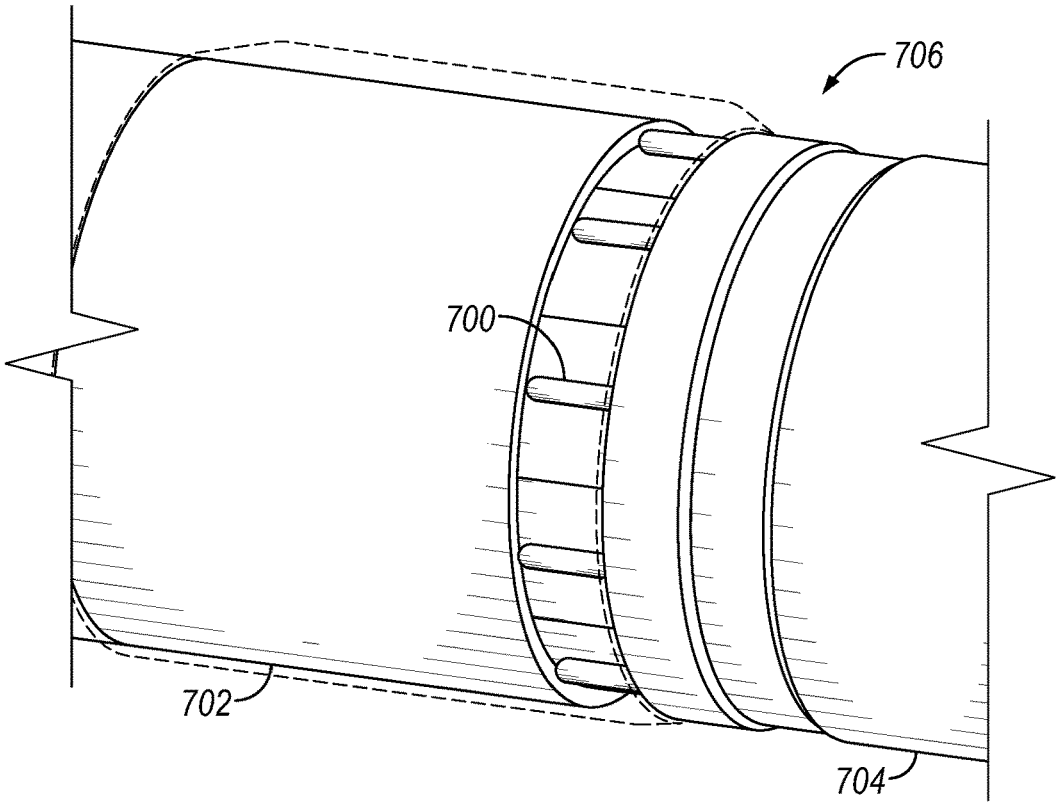
FIG. 7 is a partial view of a bearing assembly without a centralizer, according to one or more embodiments.
Figure 8:
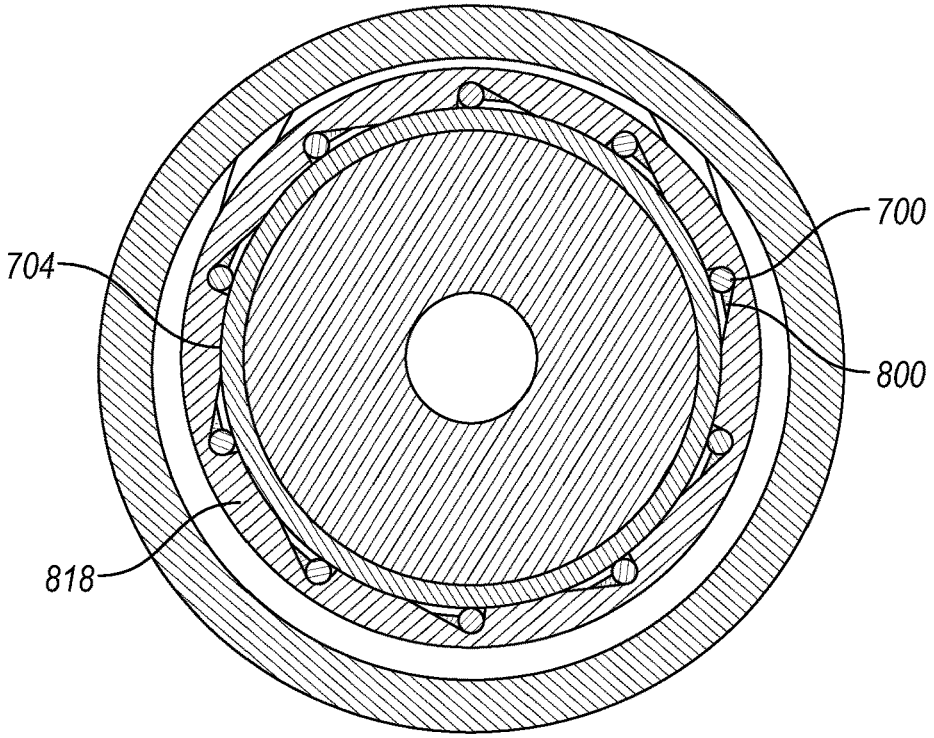
FIG. 8 is a cross-sectional view of the bearing assembly of FIG. 7 including a centralizer.

Turning now to FIGS. 7 and 8, FIGS. 7 and 8 are partial view of a centralizer assembly 706 without a centralizer 818 and a cross-sectional view of the centralizer assembly 706 of FIG. 7, respectively, according to one or more embodiments. As shown in FIGS. 7 and 8, the lower sub 704 may include rollers (one indicated, 700) or pivot cams positioned between the lower sub 704 and the centralizer 818. The rollers 700 are positioned in an alignment profile 800 formed in the centralizer 818 such that the rollers 700 and alignment profile 800 act as a one-way clutch bearing to prevent relative rotation between the lower sub 704 and the centralizer 818 in a first direction while allowing rotation in a second direction opposite the first direction.

Specifically, the alignment profile 800 and rollers 700, as shown, allow the centralizer 818 to rotate freely in a clockwise direction. However, rotating the centralizer 818 in a counter-clockwise direction causes the rollers to be compressed between the centralizer 818 and the lower sub 704 due to the alignment profile 800, preventing rotation of the centralizer 818 in the counter-clockwise direction. Additionally, the lower sub 704 may be coupled to the outer housing 702 via a left-hand thread to ensure that the centralizer 818 does not rotate as the lower sub 704 is engaged with the outer housing 702 to retain the centralizer 818.

The centralizer assembly 706 shown in FIGS. 7 and 8 allows for a reduction in the overall circumference of the drill string proximate the centralizer 818 when compared to the centralizers that use shims to retain the centralizer in position once aligned relative to the drill string. Further, the exemplary centralizer assembly 706 allows the centralizer 818 to be positioned near the drill bit, improving performance of the centralizer 818 when compared to centralizers 818 located uphole of the bearing assembly (not shown). Additionally, the centralizer assembly 706 shown in FIGS. 7 and 8 allows for precise alignment of the centralizer 818 since the centralizer 818 can be rotated into any alignment relative to the drill string (not shown).

Further examples include:

Example 1 is a drill string for drilling a borehole. The drill string includes a downhole motor operable to rotate the drill string and a centralizer assembly. The centralizer assembly includes an outer housing, a lower sub threadably engaged with the outer housing, and a centralizer. The centralizer includes a single eccentric blade, an internal shoulder positioned between the outer housing and the lower sub, and an alignment profile to align the centralizer in an azimuthal position relative to the drill string. The centralizer is retainable in the aligned azimuthal position by the alignment profile and the internal shoulder being engaged by the outer housing and the lower sub.

In Example 2, the embodiments of any preceding paragraph or combination thereof further include wherein the alignment profile of the centralizer is engageable with a mating profile of either the outer housing or the lower sub to align the centralizer.

In Example 3, the embodiments of any preceding paragraph or combination thereof further include wherein the alignment profile and the mating profile each comprise teeth.

In Example 4, the embodiments of any preceding paragraph or combination thereof further include wherein either the alignment profile or the mating profile comprises splines and the other of either the alignment profile or the mating profile comprises grooves.

In Example 5, the embodiments of any preceding paragraph or combination thereof further include wherein the alignment profile is shaped to engage with rollers to allow rotation in a first direction and prevent rotation in a second direction opposite the first direction.

In Example 6, the embodiments of any preceding paragraph or combination thereof further include further comprising a bearing assembly, wherein the centralizer assembly is either coupled to the bearing assembly or the centralizer assembly is a subassembly of the bearing assembly.

In Example 7, the embodiments of any preceding paragraph or combination thereof further include further comprising a drill bit, wherein the centralizer is positioned on the drill string between the bearing assembly and the drill bit.

Example 8 is a method for drilling a borehole with a drill string. The method includes positioning a centralizer of a centralizer assembly such that an internal shoulder of the centralized is between an outer housing of the centralizer assembly and a lower sub of the centralizer assembly. The method also includes azimuthally aligning the centralizer relative to the drill string via an alignment profile on the centralizer. The method further includes threadably engaging the lower sub with the outer housing to engage the internal shoulder and retain the centralizer in the aligned position using the alignment profile.

In Example 9, the embodiments of any preceding paragraph or combination thereof further include centralizing the drill string within the borehole while drilling the borehole via the centralizer.

In Example 10, the embodiments of any preceding paragraph or combination thereof further include supporting a driveshaft of the drill string via a bearing assembly, wherein the centralizer assembly is either coupled to the bearing assembly or the centralizer assembly is a subassembly of the bearing assembly.

In Example 11, the embodiments of any preceding paragraph or combination thereof further include wherein the centralizer is positioned on the drill string between the bearing assembly and a drill bit of the drill string.

In Example 12, the embodiments of any preceding paragraph or combination thereof further include wherein aligning the centralizer relative to the drill string comprises engaging the alignment profile of the centralizer with a mating profile on either the outer housing or the lower sub.

In Example 13, the embodiments of any preceding paragraph or combination thereof further include wherein the alignment profile and the mating profile each comprise teeth.

In Example 14, the embodiments of any preceding paragraph or combination thereof further include wherein either the alignment profile or mating profile comprises splines and the other of either the alignment profile or the mating profile comprises grooves.

In Example 15, the embodiments of any preceding paragraph or combination thereof further include wherein aligning the centralizer relative to the drill string includes rotating the centralizer in a first direction to align the centralizer. Aligning the centralizer relative to the drill string also includes engaging the alignment profile with rollers to prevent rotation in a second direction opposite the first direction.

Example 16 is a centralizer assembly for use with a drill string. The centralizer assembly includes an outer housing, a lower sub threadably engaged with the outer housing, and a centralizer. The centralizer includes a single eccentric blade, an internal shoulder positioned between the outer housing and the lower sub, and an alignment profile to align the centralizer in an azimuthal position relative to the drill string. The centralizer is retainable in the aligned azimuthal position by the alignment profile and the internal shoulder being engaged by the outer housing and the lower sub.

In Example 17, the embodiments of any preceding paragraph or combination thereof further include wherein the alignment profile of the centralizer is engageable with a mating profile of either the outer housing or the lower sub to align the centralizer.

In Example 18, the embodiments of any preceding paragraph or combination thereof further include wherein the alignment profile and the mating profile each comprise teeth.

In Example 19, the embodiments of any preceding paragraph or combination thereof further include wherein either the alignment profile or the mating profile comprises splines and the other of either the alignment profile or the mating profile comprises grooves.

In Example 20, the embodiments of any preceding paragraph or combination thereof further include wherein the alignment profile is shaped to engage with rollers to allow rotation in a first direction and prevent rotation in a second direction opposite the first direction.

Certain terms are used throughout the description and claims to refer to particular features or components. As one skilled in the art will appreciate, different persons may refer to the same feature or component by different names. This document does not intend to distinguish between components or features that differ in name but not function.

As used herein, a range that includes the term between is intended to include the upper and lower limits of the range; e.g., a range from 50 to 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 47.5 to 157.5, including 47.5 and 157.5.

Reference throughout this specification to "one embodiment," "an embodiment," "embodiments," "some embodiments," "certain embodiments," or similar language means that a particular feature, structure, or characteristic described in connector with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A drill string for drilling a borehole, the drill string comprising:

a downhole motor operable to rotate the drill string; and a centralizer assembly comprising:

an outer housing;

a lower sub threadably engaged with the outer housing;

wherein at least one of the outer housing or the lower sub comprises a mating profile located on an axially oriented face; and a centralizer comprising:

a single eccentric blade;

an internal shoulder extending radially inward from and azimuthally around an inner circumference of the centralizer, wherein the internal shoulder is positioned between the outer housing and the lower sub; and at least one alignment profile located on at least one axially oriented face to align the centralizer in an azimuthal position relative to the drill string by engagement with the at least one mating profile, the centralizer being retainable in the aligned azimuthal position by the engagement of the at least one alignment profile and the at least one mating profile and the internal shoulder being engaged by the threaded engagement of the outer housing and the lower sub.

2. The drill string of claim 1, wherein the alignment profile and the mating profile each comprise teeth.

3. The drill string of claim 1, wherein either the alignment profile or the mating profile comprises splines and the other of either the alignment profile or the mating profile comprises grooves.

4. The drill string of claim 1, wherein the alignment profile is shaped to engage with rollers to allow rotation in a first direction and prevent rotation in a second direction opposite the first direction.

5. The drill string of claim 1, further comprising a bearing assembly, wherein the centralizer assembly is either coupled to the bearing assembly or the centralizer assembly is a subassembly of the bearing assembly.

6. The drill string of claim 5, further comprising a drill bit, wherein the centralizer is positioned on the drill string between the bearing assembly and the drill bit.

7. A method for drilling a borehole with a drill string, the method comprising:

positioning a centralizer of a centralizer assembly such that an internal shoulder of the centralizer extending radially inward from and azimuthally around an inner circumference of the centralizer is between an outer housing of the centralizer assembly and a lower sub of the centralizer assembly, wherein at least one of the outer housing or the lower sub comprises a mating profile located on an axially oriented face and the centralizer comprises a single eccentric blade;

azimuthally aligning the centralizer relative to the drill string via at least one alignment profile on the centralizer located on at least one axially oriented face by engaging the alignment profile with the at least one mating profile;

threadably engaging the lower sub with the outer housing to engage the internal shoulder and retain the centralizer in the aligned position using the at least one alignment profile being engaged with the at least one mating profile; and drilling the borehole using the drill string and the centralizer assembly.

8. The method of claim 7, further comprising centralizing the drill string within the borehole while drilling the borehole via the centralizer.

9. The method of claim 7, further comprising supporting a driveshaft of the drill string via a bearing assembly, wherein the centralizer assembly is either coupled to the bearing assembly or the centralizer assembly is a subassembly of the bearing assembly.

10. The method of claim 9, wherein the centralizer is positioned on the drill string between the bearing assembly and a drill bit of the drill string.

11. The method of claim 7, wherein the alignment profile and the mating profile each comprise teeth.

12. The method of claim 7, wherein either the alignment profile or mating profile comprises splines and the other of either the alignment profile or the mating profile comprises grooves.

13. The method of claim 7, wherein aligning the centralizer relative to the drill string comprises:

rotating the centralizer in a first direction to align the centralizer; and engaging the alignment profile with rollers to prevent rotation in a second direction opposite the first direction.

14. A centralizer assembly for use with a drill string, the centralizer assembly comprising:

an outer housing;

a lower sub threadably engaged with the outer housing;

wherein at least one of the outer housing or the lower sub comprises a mating profile located on an axially oriented face; and a centralizer comprising:

a single eccentric blade;

an internal shoulder extending radially inward from and azimuthally around an inner circumference of the centralizer, wherein the internal shoulder is positioned between the outer housing and the lower sub; and at least one alignment profile located on at least one axially oriented face to align the centralizer in an azimuthal position relative to the drill string by engagement with the at least one mating profile, the centralizer being retainable in the aligned azimuthal position by the engagement of the at least one alignment profile and the at least one mating profile and the internal shoulder being engaged by the threaded engagement of the outer housing and the lower sub.

15. The centralizer of claim 14, wherein the alignment profile and the mating profile each comprise teeth.

16. The centralizer of claim 14, wherein either the alignment profile or the mating profile comprises splines and the other of either the alignment profile or the mating profile comprises grooves.

17. The centralizer of claim 14, wherein the alignment profile is shaped to engage with rollers to allow rotation in a first direction and prevent rotation in a second direction opposite the first direction.

* * * * *